US011267611B2

(12) United States Patent
Olkkonen et al.

(10) Patent No.: US 11,267,611 B2
(45) Date of Patent: Mar. 8, 2022

(54) PALLET FOR CARRYING A LOAD

(71) Applicant: Wimao Oy, Konnunsuo (FI)

(72) Inventors: Veikko Olkkonen, Konnunsuo (FI); Ville Immonen, Konnunsuo (FI); Juha Varis, Konnunsuo (FI)

(73) Assignee: WIMAO OY, Konnunsuo (FI)

( * ) Notice: Subject to any disclaimer, the term of this patent is extended or adjusted under 35 U.S.C. 154(b) by 0 days.

(21) Appl. No.: 17/091,603

(22) Filed: Nov. 6, 2020

(65) Prior Publication Data

US 2021/0139195 A1 May 13, 2021

(30) Foreign Application Priority Data

Nov. 7, 2019 (EP) ..... 19207700

(51) Int. Cl.
*B65D 19/00* (2006.01)

(52) U.S. Cl.
CPC ..... *B65D 19/0073* (2013.01); *B65D 2519/00069* (2013.01); *B65D 2519/00129* (2013.01); *B65D 2519/00273* (2013.01); *B65D 2519/00293* (2013.01); *B65D 2519/00323* (2013.01); *B65D 2519/00333* (2013.01); *B65D 2519/00432* (2013.01)

(58) Field of Classification Search
CPC ..... B65D 19/0073; B65D 19/00; B65D 2519/00034
USPC ..... 108/51.11, 57.25
See application file for complete search history.

(56) References Cited

U.S. PATENT DOCUMENTS 1,698,038 A * 1/1929 Warshaw ..... B65D 19/0075 108/57.24
1,770,614 A * 7/1930 Daniele ..... B65D 19/0075 108/57.25
3,187,688 A * 6/1965 Kreilick ..... B65D 19/0085 108/57.32
4,159,681 A * 7/1979 Vandament ..... B65D 19/0026 108/57.33
4,291,632 A * 9/1981 Barty ..... B65D 19/0002 108/51.11

(Continued)

FOREIGN PATENT DOCUMENTS

DE 2722315 A1 12/1977
EP 0 718 201 A1 6/1996
WO 2015/118456 A1 8/2015

OTHER PUBLICATIONS

Extended European Search Report issued in European Patent Application No. 19207700.6 dated Apr. 6, 2020.

*Primary Examiner* — Jose V Chen
(74) *Attorney, Agent, or Firm* — Nixon & Vanderhye

(57) ABSTRACT

A pallet (100) comprises a platform section (101) and foot sections (103-107) protruding downwards from the platform section. The pallet comprises at least one elongated support element (108) between opposite edge areas of the pallet and going via a lower portion of a foot section (107) that is between and distances away from the opposite edge areas of the pallet. The elongated support element is connected to the opposite edge areas of the pallet with connections (109, 110) for receiving tensile stress acting on the elongated support element. The tensile stress of the elongated support element is increased in response to downwards arching bending of the platform section. Thus, the elongated support element tends to prevent the bending of the platform section.

17 Claims, 4 Drawing Sheets

(56) References Cited

U.S. PATENT DOCUMENTS 4,586,303 A * 5/1986 Jartoux ..... E01D 19/14 52/309.16
4,735,154 A * 4/1988 Hemery ..... B65D 19/0012 108/56.1
4,869,179 A * 9/1989 Sammons ..... B65D 19/0073 108/56.1
5,042,396 A * 8/1991 Shuert ..... B65D 19/0012 108/57.25
5,108,529 A * 4/1992 Shuert ..... B29C 51/04 156/212
5,337,681 A * 8/1994 Schrage ..... B65D 19/0071 108/56.1
5,687,652 A * 11/1997 Ruma ..... B65D 19/0026 108/57.25
5,758,855 A * 6/1998 Jordan ..... B65D 19/0026 156/196
5,868,080 A * 2/1999 Wyler ..... B65D 19/0026 108/57.25
6,053,466 A 4/2000 Jordan et al.
6,250,234 B1 * 6/2001 Apps ..... B29C 66/1142 108/57.25
6,357,366 B1 * 3/2002 Frankenberg ..... B65D 19/0026 108/57.25
7,661,373 B2 * 2/2010 Apps ..... B65D 19/0012 108/56.3
9,511,898 B2 * 12/2016 Liao ..... B65D 19/0028
9,669,962 B2 * 6/2017 Liao ..... B65D 19/0097
2004/0159266 A1 * 8/2004 Fisch ..... B65D 19/0036 108/57.25
2004/0255828 A1 * 12/2004 Markling ..... B65D 19/0016 108/57.25
2005/0263044 A1 * 12/2005 Bearse ..... B29C 51/165 108/57.25
2006/0201399 A1 * 9/2006 Swistak ..... B65D 19/0059 108/57.25
2006/0201402 A1 * 9/2006 Moore, Jr. ..... B65D 19/0038 108/57.25
2006/0254473 A1 * 11/2006 Creighton ..... B65D 19/36 108/51.11
2008/0295748 A1 * 12/2008 Yoshida ..... B65D 19/0026 108/55.1
2009/0241461 A1 * 10/2009 Linares ..... B65D 19/004 52/592.1
2012/0037050 A1 2/2012 Nevo et al.
2013/0136573 A1 * 5/2013 Berry ..... B65D 21/0233 414/800
2015/0013573 A1 1/2015 Nevo
2016/0046406 A1 * 2/2016 Semlitsch ..... B65D 19/0002 108/57.25
2019/0367215 A1 * 12/2019 D'Emidio ..... B65D 19/0016

* cited by examiner

PALLET FOR CARRYING A LOAD

This application claims priority to EP Patent Application No. 19207700.6 filed Nov. 7, 2019, the entire contents of each of which are hereby incorporated by reference.

TECHNICAL FIELD

The disclosure relates to a pallet for carrying a load. More particularly, the disclosure relates to a mechanical structure of a pallet.

BACKGROUND

A pallet is a substantially flat transport structure which supports goods in a stable fashion while being lifted by a forklift, a pallet jack, a front loader, a jacking device, or an erect crane. A pallet can be used as a foundation of a unit load, which allows effective handling and storage of goods. Goods placed on a pallet are often secured with strapping, stretch wrap, or shrink wrap. While most pallets are wooden, pallets can also be made of plastic, metal, paper, and recycled materials. It is also possible that a pallet is made of many different materials. Typically, a pallet comprises a platform section having an upper side for carrying load and foot sections protruding downwards from the platform section. A pallet may comprise for example nine foot sections which are arranged into a 3×3 pattern. Furthermore, a pallet may comprise lower chords between lower portions of the foot sections and parallel with the platform section.

In many cases, a pallet is on a floor or another flat surface which provides mechanical support for all foot sections of the pallet. It is however also possible that e.g. a shelving system of a storehouse comprises rails for supporting pallets so that foot sections of two opposite edges of the pallet are supported whereas other foot sections that are between the first mentioned foot sections are not mechanically supported. In this case, a load on the pallet may tend to bend the platform section of the pallet in a downwards arching way. A similar situation may take place when a pallet is on an uneven surface which does not provide mechanical support for all foot sections of the pallet. Therefore, a pallet needs to be stiff enough against forces tending to bend the platform section. As mentioned above, a pallet can be made of many different materials. Many materials that would be economical for pallets can be sufficiently strong against compression stress but strength against tensile stress can be significantly lower. It may be challenging to achieve enough stiffness and mechanical strength if material of a pallet is weak against tensile stress.

SUMMARY

The following presents a simplified summary in order to provide a basic understanding of some aspects of various invention embodiments. The summary is not an extensive overview of the invention. It is neither intended to identify key or critical elements of the invention nor to delineate the scope of the invention. The following summary merely presents some concepts of the invention in a simplified form as a prelude to a more detailed description of exemplifying embodiments of the invention.

In this document, the word "geometric" when used as a prefix means a geometric concept that is not necessarily a part of any physical object. The geometric concept can be for example a geometric point, a straight or curved geometric line, a planar or non-planar geometric surface, a geometric space, or any other geometric entity that is zero, one, two, or three dimensional.

In accordance with the invention, there is provided a new pallet for carrying a load. A pallet according to the invention comprises:

- a platform section having an upper side for carrying load,
- foot sections protruding downwards from the platform section, and
- at least one elongated support element between opposite edge areas of the pallet and going via a lower portion of at least one first foot section that is between and distances away from the opposite edge areas of the pallet, the at least one first foot section belonging to the foot sections of the pallet.

The elongated support element is connected to the opposite edge areas of the pallet with connections for receiving tensile stress acting on the elongated support element, and the tensile stress of the elongated support element is increased in response to downwards arching bending of the platform section. Therefore, the elongated support element acts against the bending of the platform section and thereby the elongated support element improves the stiffness of the pallet.

In a pallet according to an exemplifying and non-limiting embodiment, the elongated support element is so thin that the cross-section of the elongated support element in terms of its area is less than 3% of area of a geometric surface delimited by a shortest closed geometric curve capable of surrounding the first foot section. In a pallet according to an exemplifying and non-limiting embodiment, the elongated support element is so thin that the cross-section of the elongated support element in terms of its area is less than 2.5% of the area of the above-mentioned geometric surface. In a pallet according to an exemplifying and non-limiting embodiment, the elongated support element is so thin that the cross-section of the elongated support element in terms of its area is less than 2% of the area of the above-mentioned geometric surface. In a pallet according to an exemplifying and non-limiting embodiment, the elongated support element is so thin that the cross-section of the elongated support element in terms of its area is less than 1.5% of the area of the above-mentioned geometric surface. In a pallet according to an exemplifying and non-limiting embodiment, the elongated support element is so thin that the cross-section of the elongated support element in terms of its area is less than 1% of the area of the above-mentioned geometric surface.

In a pallet according to an exemplifying and non-limiting embodiment, the elongated support element is so thin that the cross-section of the elongated support element in terms of its area is less than 2% of area of a base of a smallest volume geometric circular cylinder capable of including the first foot section. In a pallet according to an exemplifying and non-limiting embodiment, the elongated support element is so thin that the cross-section of the elongated support element in terms of its area is less than 1.75% of the area of the base of the smallest volume geometric circular cylinder capable of including the first foot section. In a pallet according to an exemplifying and non-limiting embodiment, the elongated support element is so thin that the cross-section of the elongated support element in terms of its area is less than 1.5% of the area of the base of the smallest volume geometric circular cylinder capable of including the first foot section. In a pallet according to an exemplifying and non-limiting embodiment, the elongated support element is so thin that the cross-section of the elongated support element in terms of its area is less than 1.25 of the area of the base of the smallest volume geometric circular cylinder capable of including the first foot section. In a pallet according to an exemplifying and non-limiting embodiment, the elongated support element is so thin that the cross-section of the elongated support element in terms of its area is less than 1% of the area of the base of the smallest volume geometric circular cylinder capable of including the first foot section. In a pallet according to an exemplifying and non-limiting embodiment, the elongated support element is so thin that the cross-section of the elongated support element in terms of its area is less than 0.75% of the area of the base of the smallest volume geometric circular cylinder capable of including the first foot section.

Exemplifying and non-limiting embodiments are described in accompanied dependent claims.

Various exemplifying and non-limiting embodiments both as to constructions and to methods of operation, together with additional objects and advantages thereof, will be best understood from the following description of specific exemplifying and non-limiting embodiments when read in conjunction with the accompanying drawings.

The verbs "to comprise" and "to include" are used in this document as open limitations that neither exclude nor require the existence of unrecited features. The features recited in dependent claims are mutually freely combinable unless otherwise explicitly stated. Furthermore, it is to be understood that the use of "a" or "an", i.e. a singular form, throughout this document does not exclude a plurality.

BRIEF DESCRIPTION OF FIGURES

Exemplifying and non-limiting embodiments and their advantages are explained in greater detail below in the sense of examples and with reference to the accompanying drawings, in which.

DESCRIPTION OF EXEMPLIFYING AND NON-LIMITING EMBODIMENTS

The specific examples provided in the description below should not be construed as limiting the scope and/or the applicability of the accompanied claims. Lists and groups of examples provided in the description are not exhaustive unless otherwise explicitly stated.

Figure 1A:
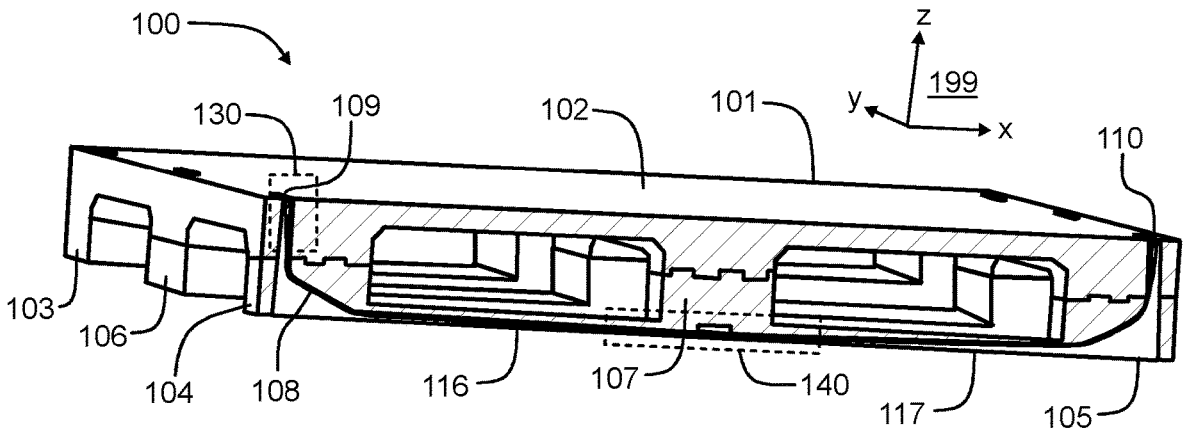
FIGS. 1*a*, 1*b*, 1*c*, 1*d*, 1*e*, and 1*f* illustrate a pallet according to an exemplifying and non-limiting embodiment.
Figure 1B:
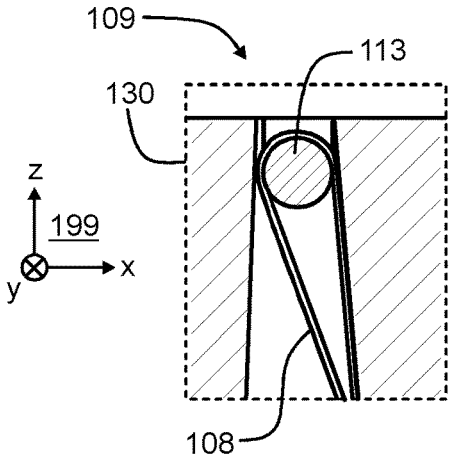
Figure 1C:
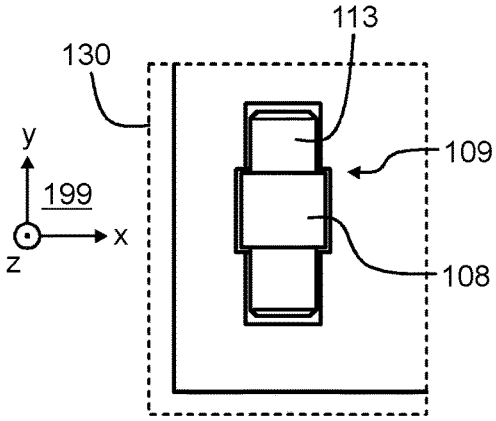
Figure 1D:
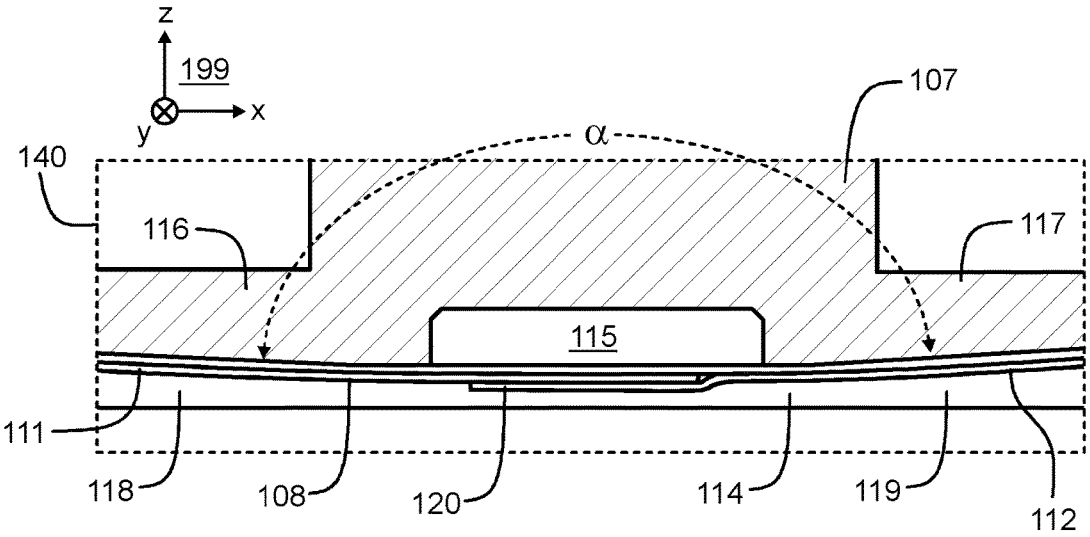
Figure 1E:
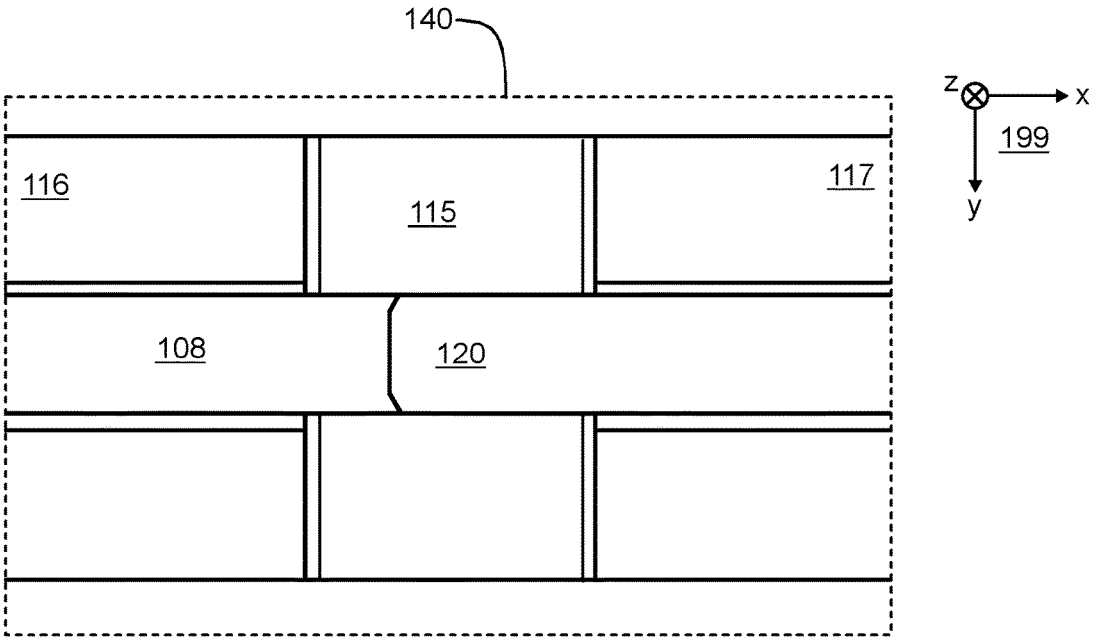

FIG. 1*a* shows a perspective and section view of a pallet 100 according to an exemplifying and non-limiting embodiment. The section surface is denoted with a diagonal hatching, and the geometric section plane is parallel with the xz-plane of a coordinate system. FIGS. 1*b* and 1*c* illustrate a detail 130 of the pallet, and FIGS. 1*d* and 1*e* illustrate a detail 140 of the pallet. The pallet 100 comprises a platform section 101 having an upper side 102 for carrying load. The pallet 100 comprises foot sections protruding downwards from the platform section 101. In FIG. 1*a*, five of the foot sections are denoted with references 103, 104, 105, 106, and 107. The platform section 101 and the foot sections can be made of for example recycled plastic.

Figure 1F:
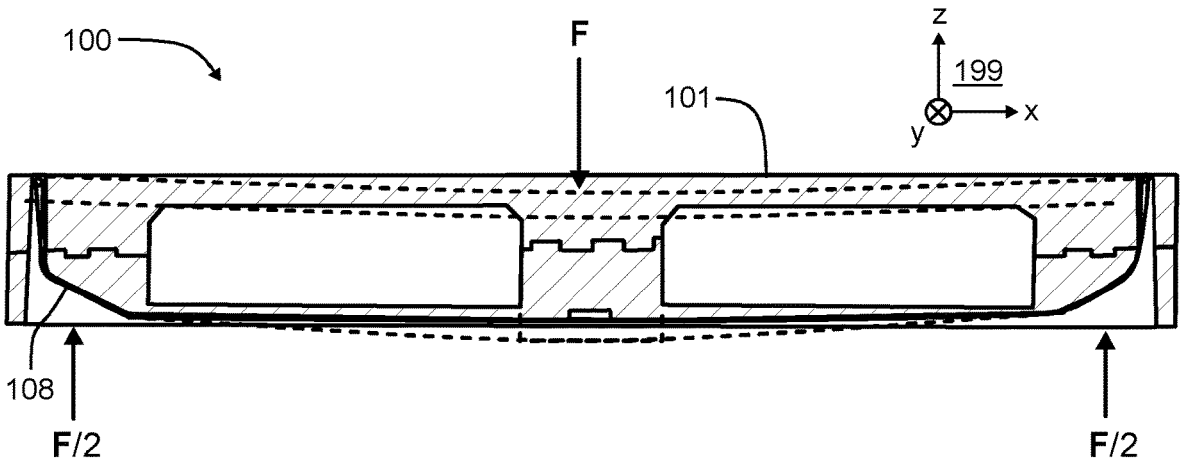

The pallet 100 comprises elongated support elements each of which is between opposite edge areas of the pallet 100 and goes via a lower portion of a foot section that is between and distances away from the opposite edge areas of the pallet. Each elongated support element is connected to the respective opposite edge areas of the pallet 100 with connections for receiving tensile stress acting on the elongated support element. In FIGS. 1*a*-1*e*, one of the elongated support elements is denoted with a reference 108. As illustrated in the section view shown in FIG. 1*a*, the elongated support element 108 is between the connections 109 and 110 and goes via a lower portion of the foot section 107. Tensile stress acting on each elongated support element is increased in response to downwards arching bending of the platform section 101. FIG. 1*f* illustrates an exemplifying situation in which forces F, F/2, and F/2 are directed to the pallet 100. Downwards arching bending of the platform section 101 is illustrated with dashed lines in an exaggerated way. As illustrated in FIG. 1*f*, the downwards arching bending of the platform section 101 tends to stretch the elongated support element 108 and therefore the tensile stress acting on the elongated support element 108 is increased in response to the downwards arching bending of the platform section 101. Therefore, the elongated support element 108 tends to prevent the bending of the platform section 101 and thereby the elongated support element 108 improves the stiffness of the pallet 100. In FIGS. 1*a*-1*f*, the downwards direction is the negative z-direction of the coordinate system 199.

The exemplifying pallet 100 illustrated in FIGS. 1*a*-1*f* comprises three elongated support elements so that each x-directional row of foot sections is provided with an elongated support element. It is however also possible that a pallet according to an exemplifying and non-limiting embodiment comprises two elongated support elements so that only the outmost ones of the x-directional rows of foot sections are provided with elongated support elements. Furthermore, it is also possible that a pallet according to an exemplifying and non-limiting embodiment comprises only one elongated support element so that only the middle one of the x-directional rows of foot sections is provided with an elongated support element. It is also possible that a pallet according to an exemplifying and non-limiting embodiment comprises elongated support elements in both x- and y-directional rows of foot sections.

In the exemplifying pallet 100 illustrated in FIGS. 1*a*-1*f*, each elongated support element has a downwards convex profile between the connections for receiving the tensile stress acting on the elongated support element. The height difference between the lowest point of the elongated support element and the above-mentioned connections is, advantageously but not necessarily, at least 50% of the height of the pallet. As illustrated in the section view shown in FIG. 1*a*, the elongated support element 108 has a downwards convex profile between the connections 109 and 110 for receiving the tensile stress acting on the elongated support element 108. In the exemplifying pallet 100 illustrated in FIGS. 1*a*-1*f*, the connections for receiving the tensile stresses of the elongated support elements are located in the platform section 101. In the exemplifying pallet 100 illustrated in FIGS. 1*a*-1*f*, the height difference between the lowest point of the elongated support element 108 and the connections 109 and 110 is more than 90% of the height of the pallet 100.

In the exemplifying pallet 100 illustrated in FIGS. 1*a*-1*f*, a middle portion of each elongated support element is arranged to form a blunt and upwards opening angle. As illustrated in the section view shown in FIG. 1*d*, there is a blunt and upwards opening angle $\alpha$ between portions 111 and 112 of the elongated support element 108 that are on different sides of the lower portion of the foot section 107. The angle $\alpha$ improves the ability of the elongated support element 108 to resist downwards arching bending of the platform section 101 because a vertical, i.e. z-directional, force directed by the elongated support element 108 to the foot section 107 is proportional to the product of cos(α/2) and the tensile stress of the elongated support element 108. It is however also possible that in a pallet according to an exemplifying and non-limiting embodiment the above-mentioned angle α is a straight angle i.e. 180 degrees.

In the exemplifying pallet 100 illustrated in FIGS. 1*a*-1*f*, each elongated support element is a flexible band that is arranged to constitute a closed loop, where both an upper portion and a lower portion of the closed loop go via the lower portion of the foot section 107. The flexible band has a length, a width, and a thickness so that the length is greater than the width that is, in turn, greater than the thickness. In this context, the word "flexible" means that the band does not have load bearing stiffness against bending. In a pallet according to another exemplifying and non-limiting embodiment, each elongated support element can be e.g. a steel rope. It is also possible that each elongated support element is some other elongated flexible element, e.g. a chain, that has no load bearing stiffness against bending. The material of the flexible band can be e.g. steel. FIGS. 1*d* and 1*e* show a joint 120 between ends of the flexible band to form the above-mentioned closed loop. Each of the connections for receiving the tensile stress of the respective elongated support element has a part protruding through the above-mentioned closed loop. The connection 109 for receiving the tensile stress of the elongated support element 108 is illustrated in FIGS. 1*b* and 1*c*. The connection 109 has a part 113 that is arranged to protrude through the closed loop constituted by the elongated support element 108. In this exemplifying case, the part 113 is a round rod that protrudes through the closed loop constituted by the elongated support element 108.

As illustrated in FIG. 1*d*, the bottom surface of the foot section 107 comprises a groove 114 for the elongated support element 108. Thanks to the groove 114, the elongated support element 108 does not need to be in contact with a floor when the pallet 100 is on the floor. Likewise, the bottom surfaces of the other corresponding foot sections have grooves of the kind mentioned above for the respective elongated support elements. It is however also possible that in a pallet according to an exemplifying and non-limiting embodiment the lower portions of the corresponding foot sections comprise e.g. apertures for the elongated support elements.

As illustrated in FIG. 1*d*, the bottom surface of the foot section 107 comprises a recess 115 so that there is a free room between the elongated support element 108 and the bottom of the recess 115. The above-mentioned free room facilitates usage of a tool for making the above-mentioned joint 120. Likewise, the bottom surfaces of the other corresponding foot sections of the pallet 100 have similar recesses. It is however also possible that in a pallet according to an exemplifying and non-limiting embodiment the lower portions of the corresponding foot sections do not comprise recesses of the kind mentioned above.

The exemplifying pallet 100 illustrated in FIGS. 1*a*-1*f* comprises lower chords between lower portions of the foot sections and parallel with the platform section 101. In FIG. 1*a*, the lower chords which are between the lower portions of the foot sections 104, 107, and 105 are denoted with references 116 and 117. In this exemplifying case, the bottom surfaces of the lower chords comprise grooves for the elongated support elements. In FIG. 1*d*, the grooves of the lower chords 116 and 117 are denoted with references 118 and 119. It is however also possible that a pallet according to an exemplifying and non-limiting embodiment does not comprise lower chords, or the pallet comprises lower chords, but the lower chords do not comprise grooves of the kind mentioned above. A pallet according to an exemplifying and non-limiting embodiment comprises strengthening elements that are attached to the lower chords with the aid of the elongated support elements. The strengthening elements can be arranged to protect the elongated support elements against mechanical impacts that may occur when handling the pallet with e.g. a forklift. The foot sections and the strengthening elements can be e.g. shape locked to each other so that the strengthening elements are able to receive tensile stress.

The exemplifying pallet 100 illustrated in FIGS. 1*a*-1*f* comprises an upper element and three lower elements. The upper element constitutes the platform section 101 and upper portions of the foot sections. The three lower elements constitute lower portions of the foot sections and the lower chords. In this exemplifying pallet 100, the elongated support elements are used not only for improving the stiffness of the pallet 100 but also for attaching the above-mentioned lower elements to the upper element.

Figure 2:
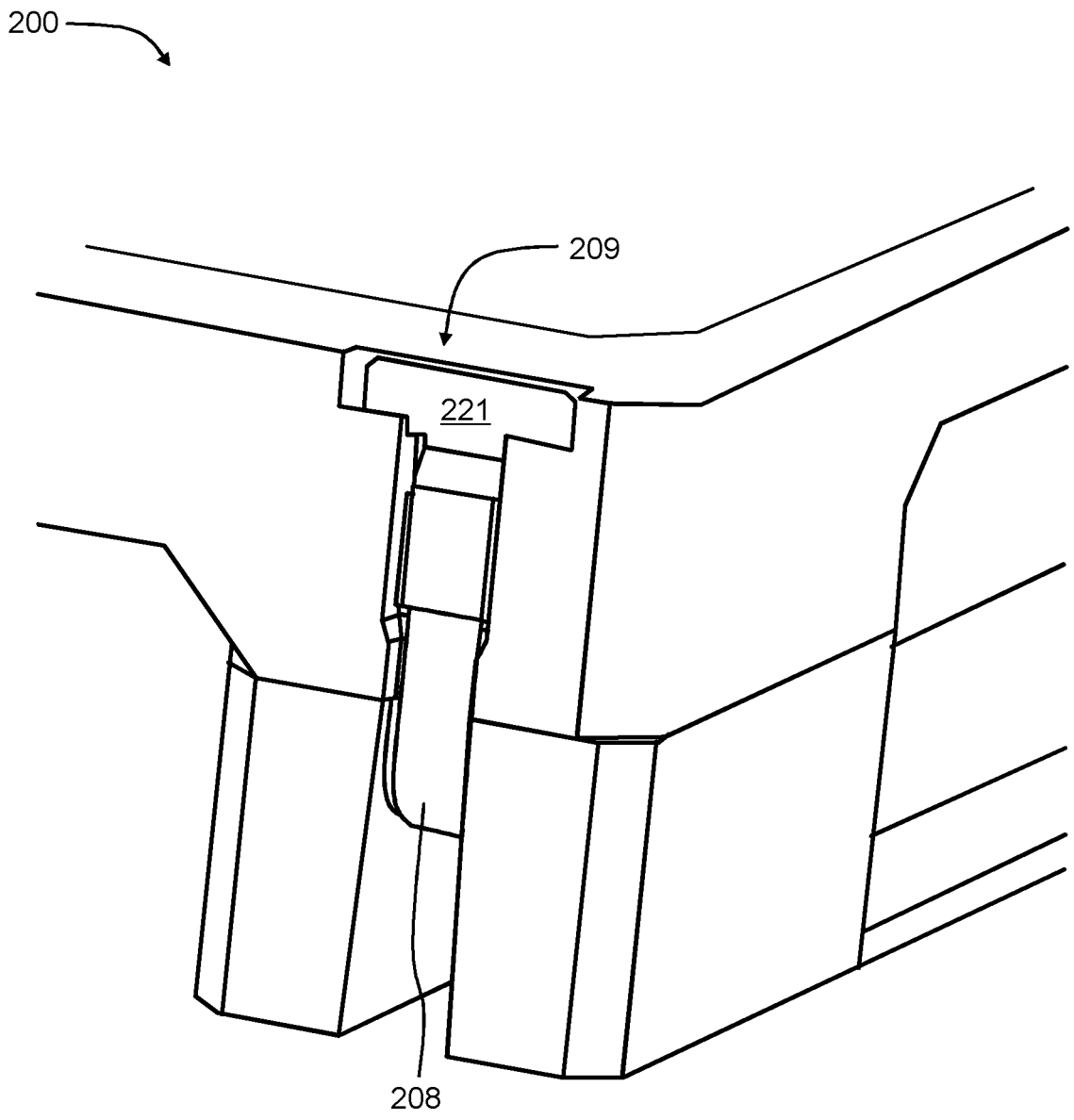
FIG. 2 illustrates a detail of a pallet according to an exemplifying and non-limiting embodiment.

FIG. 2 illustrates a detail of a pallet 200 according to an exemplifying and non-limiting embodiment. The pallet 200 can be otherwise like the pallet 100 illustrated in FIGS. 1*a*-1*f*, but the elongated support elements of the pallet 200 do not constitute closed loops and are connected to edge areas of the pallet 200 in a different way than in the pallet 100. FIG. 2 shows a connection 209 for receiving the tensile stress acting on an elongated support element 208. The connection 209 comprises a T-shaped element 221 that is adapted to fit with a corresponding recess on an edge area of the pallet 200. In this exemplifying case, the elongated support element 208 is attached to the T-shaped element 221 with a crimped connection.

Figure 3A:
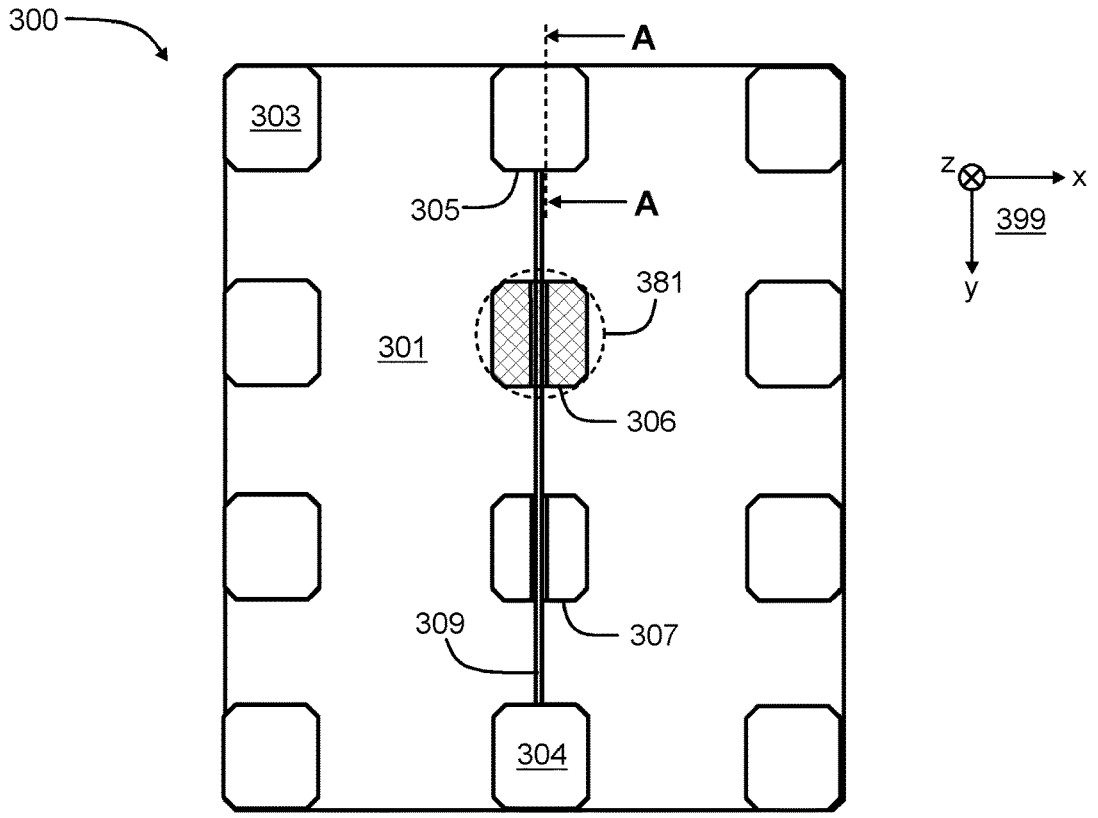
FIGS. 3*a* and 3*b* illustrate a pallet according to an exemplifying and non-limiting embodiment.
Figure 3B:
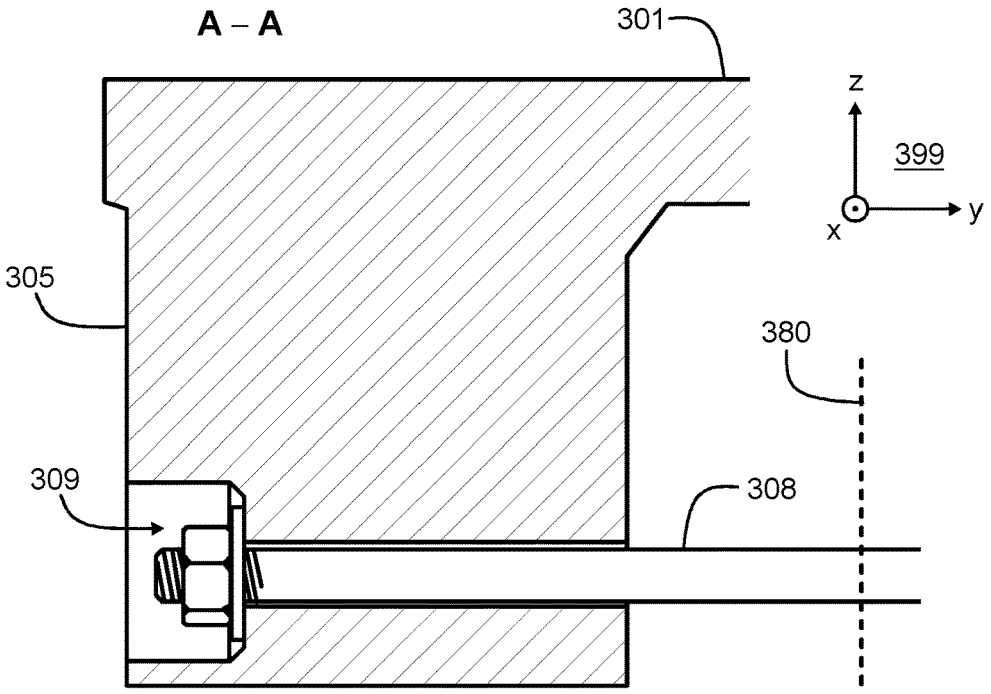

FIG. 3*a* shows a bottom view of a pallet 300 according to an exemplifying and non-limiting embodiment. FIG. 3*b* shows a view of a section taken along a line A-A shown in FIG. 3*a*. The geometric section plane is parallel with the yz-plane of a coordinate system 399. The pallet 300 comprises a platform section 301 and foot sections protruding downwards from the platform section. In FIG. 3*a*, five of the foot sections are denoted with references 303, 304, 305, 306, and 307. The pallet 300 comprises an elongated support element 308 that is between opposite edge areas of the pallet and goes via lower portions of the foot sections 306 and 308. The elongated support element 308 is connected to the opposite edge areas of the pallet 300 with connections for receiving tensile stress acting on the elongated support element 308. In this exemplifying case, the opposite edge areas of the pallet 300 are on lower portions of the foot sections 304 and 305. The tensile stress acting on the elongated support element 308 is increased in response to downwards arching bending of the platform section 301. In FIGS. 3*a* and 3*b*, the downwards direction is the negative z-direction of the coordinate system 399. In FIG. 3*b*, the connection in the lower portion of the foot section 305 is denoted with a reference 309. In this exemplifying case, the elongated support element 308 is a rod that has threaded ends. The connection 309 comprises a nut and a washer for receiving the tensile stress of the elongated support element 308.

In a pallet according to an exemplifying and non-limiting embodiment, the elongated support element is so thin that the cross-section of the elongated support element in terms of its area is less than 3%, or less than 2.5%, or less than 2%, or less than 1.5%, or less than 1% of area of a geometric surface delimited by a shortest closed geometric curve capable of surrounding a foot section of the pallet. The above-mentioned cross-section of the elongated support element is taken along a geometric plane that is perpendicular to the longitudinal direction of the elongated support element. In FIG. 3*b*, an exemplifying geometric plane that is perpendicular to the longitudinal direction of the elongated support element 308 is depicted with a dashed line 380. The exemplifying geometric plane is parallel with the xz-plane of the coordinate system 399. A geometric surface delimited by a shortest closed geometric curve capable of surrounding the foot section 306 is depicted with cross-hatching in FIG. 3*a*.

In a pallet according to an exemplifying and non-limiting embodiment, the elongated support element is so thin that the cross-section of the elongated support element in terms of its area is less than 2%, or less than 1.75%, or less than 1.5%, or less than 1.25%, or less than 1%, or less than 0.75% of area of a base of a smallest volume geometric circular cylinder capable of including a foot section of the pallet. In FIG. 3*a*, the base of the smallest volume geometric circular cylinder capable of including the foot section 306 is depicted with a circle 381.

The specific examples provided in the description given above should not be construed as limiting the applicability and/or interpretation of the appended claims. It is to be noted that lists and groups of examples given in this document are non-exhaustive lists and groups unless otherwise explicitly stated.

What is claimed is:

1. A pallet comprising:

a platform section having an upper side for carrying load, foot sections protruding downwards from the platform section, and at least one elongated support element between opposite edge areas of the pallet and going via a lower portion of at least one first foot section that is between and distances away from the opposite edge areas of the pallet, the at least one first foot section belonging to the foot sections of the pallet, wherein the elongated support element is connected to the opposite edge areas of the pallet with connections for receiving tensile stress acting on the elongated support element, and the tensile stress acting on the elongated support element is increased in response to downwards arching bending of the platform section, and wherein the elongated support element is an elongated flexible element without load bearing stiffness against bending, and the elongated support element constitutes a closed loop and each of the connections for receiving the tensile stress has a part protruding through the closed loop, both branches of the closed loop between the connections going via the lower portion of the at least one first foot section.

2. A pallet according to claim 1, wherein a cross-section of the elongated support element in terms of its area is less than 3% of area of a geometric surface delimited by a shortest closed geometric curve capable of surrounding the first foot section.

3. A pallet according to claim 2, wherein a bottom surface of the first foot section comprises a groove for the elongated support element.

4. A pallet according to claim 3, wherein a bottom surface of the first foot section comprises a recess forming a free room between the elongated support element and a bottom of the recess.

5. A pallet according to claim 2, wherein a bottom surface of the first foot section comprises a recess forming a free room between the elongated support element and a bottom of the recess.

6. A pallet according to claim 1, wherein a cross-section of the elongated support element in terms of its area is less than 2% of area of a base of a smallest volume geometric circular cylinder capable of including the first foot section.

7. A pallet according to claim 1, wherein the elongated support element has a downwards convex profile between the connections for receiving the tensile stress acting on the elongated support element.

8. A pallet according to claim 7, wherein a height difference between a lowest point of the elongated support element and the connections for receiving the tensile stress is at least 50% of a height of the pallet.

9. A pallet according to claim 1, wherein there is a straight angle or a blunt and upwards opening angle between portions of the elongated support element on different sides of the lower portion of the first foot section.

10. A pallet according to claim 1, wherein there is a blunt and upwards opening angle between portions of the elongated support element on different sides of the lower portion of the first foot section.

11. A pallet according to claim 1, wherein a bottom surface of the first foot section comprises a groove for the elongated support element.

12. A pallet according to claim 1, wherein a bottom surface of the first foot section comprises a recess forming a free room between the elongated support element and a bottom of the recess.

13. A pallet according to claim 1, wherein the pallet comprises lower chords between lower portions of the foot sections and parallel with the platform section.

14. A pallet according to claim 13, wherein bottom surfaces of the lower chords comprise grooves for the elongated support element.

15. A pallet according to claim 1, wherein the elongated support element is an elongated flexible element without load bearing stiffness against bending.

16. A pallet according to claim 15, wherein the elongated support element (108) is a flexible band.

17. A pallet according to claim 16, wherein the flexible band is made of steel.

* * * * *